US007258842B2

(12) United States Patent
Brück et al.

(10) Patent No.: US 7,258,842 B2
(45) Date of Patent: Aug. 21, 2007

(54) CATALYST ASSEMBLY WITH A FIXED CATALYST CARRIER BODY

(75) Inventors: Rolf Brück, Bergisch Gladbach (DE); Wolfgang Maus, Bergisch Gladbach (DE); Katrin Schaper, Siegburg (DE); Jörg-Roman Konieczny, Siegburg (DE)

(73) Assignee: Emitec Gesellschaft fuer Emissionstechnologie mbH, Lohmar (DE)

( * ) Notice: Subject to any disclaimer, the term of this patent is extended or adjusted under 35 U.S.C. 154(b) by 863 days.

(21) Appl. No.: 10/393,034

(22) Filed: Mar. 20, 2003

(65) Prior Publication Data

US 2003/0180198 A1 Sep. 25, 2003

Related U.S. Application Data

(63) Continuation of application No. PCT/EP01/10618, filed on Sep. 14, 2001.

(30) Foreign Application Priority Data

Sep. 20, 2000 (DE) ..... 100 46 610

(51) Int. Cl.
*B01D 50/00* (2006.01)
*B01D 53/34* (2006.01)
*B01J 8/02* (2006.01)

(52) U.S. Cl. ..... 422/179; 422/181; 422/180; 422/221; 422/171; 422/177

(58) Field of Classification Search ..... 422/179, 422/180; 502/439
See application file for complete search history.

(56) References Cited

U.S. PATENT DOCUMENTS 3,892,537 A 7/1975 Gulati et al. ..... 422/179
4,158,037 A 6/1979 Aoyama ..... 422/179
4,248,833 A * 2/1981 Aoyama ..... 422/179
4,335,077 A 6/1982 Santiago et al. ..... 422/179
4,344,921 A 8/1982 Santiago et al. ..... 422/179
4,482,304 A 11/1984 Brobeck et al. ..... 417/407
4,619,912 A 10/1986 Jalbing et al. ..... 502/439
4,750,251 A * 6/1988 Motley et al. ..... 29/890
4,775,518 A 10/1988 Abthoff et al. ..... 422/179

(Continued)

FOREIGN PATENT DOCUMENTS

DE 2 222 663 12/1973

(Continued)

*Primary Examiner*—Glenn Caldarola
*Assistant Examiner*—Kaity Handal
(74) *Attorney, Agent, or Firm*—Laurence A. Greenberg; Warner H. Stemer; Ralph E. Locher

(57) ABSTRACT

A catalyst assembly includes a housing having at least first and second recesses with side surfaces, and a catalyst carrier body fixed in said housing. The catalyst carrier body has a casing tube and a honeycomb body through which an exhaust gas can flow. The casing tube has at least first and second protuberances with side surfaces and said casing tube is connected to said honeycomb body at least in a partial region. The protuberances extend at least partially into said recesses to form a fixed mounting and at least one floating mounting with an axial mounting play. The assembly ensures that the catalyst carrier body is permanently fixed, in particular during structure-borne vibrations that occur in the exhaust system of an internal combustion engine.

18 Claims, 3 Drawing Sheets

U.S. PATENT DOCUMENTS

| | | | | |
|---|---|---|---|---|
| 4,795,615 | A | 1/1989 | Cyron et al. | 422/179 |
| 5,116,581 | A * | 5/1992 | Cyron et al. | 422/180 |

FOREIGN PATENT DOCUMENTS

| | | | |
|---|---|---|---|
| DE | 2 308 220 | | 9/1974 |
| DE | 27 46 475 | A1 | 4/1979 |
| DE | 30 36 890 | A1 | 4/1982 |
| DE | 31 31 190 | A1 | 3/1983 |
| DE | 38 04 559 | A1 | 5/1989 |
| DE | 44 30 645 | A1 | 3/1996 |
| EP | 0 212 243 | A1 | 3/1987 |
| EP | 0 212 243 | B1 | 3/1987 |
| EP | 0 336 115 | A1 | 10/1989 |
| GB | 2 084 251 | A | 4/1982 |
| GB | 2 103 285 | A | 2/1983 |
| JP | 55109716 | | 8/1980 |
| JP | 62284915 | | 12/1987 |

* cited by examiner

CATALYST ASSEMBLY WITH A FIXED CATALYST CARRIER BODY

CROSS-REFERENCE TO RELATED APPLICATION

This application is a continuation of copending International Application No. PCT/EP01/10618, filed Sep. 14, 2001, which designated the United States and was not published in English.

BACKGROUND OF THE INVENTION

Field of the Invention

The present invention relates to a catalyst assembly, including a housing and a catalyst carrier body fixed in the housing. The catalyst carrier body has a casing tube and a honeycomb body through which an exhaust gas can flow. The casing tube has at least first and second protuberances with side surfaces and is connected to the honeycomb body at least in a partial region. The housing has at least first and second recesses with side surfaces. Catalyst carrier bodies of that type are used, for example, in exhaust systems of internal combustion engines, in particular in automotive engineering.

An example of a configuration of that type is known, for example, from European Patent Application 0 212 243 A1, corresponding to U.S. Pat. No. 4,795,615. That document proposes a holder for a metallic exhaust-gas catalyst carrier body in a casing tube. In that configuration, the catalyst carrier body is embedded or secured in such a way that thermal expansion in the longitudinal direction is not impeded. The holder is constructed with two or more spacers, with the result that the catalyst carrier body is held inside the casing tube at a distance of a few millimeters. Just one spacer is fixedly connected to both the catalyst carrier body and the casing tube. That prevents stresses which may have an adverse effect on the service life of a holder of that type from forming as a result of the different thermal expansion characteristics of the casing tube and the catalyst carrier body.

Tests have shown that when engines used in automotive engineering are operating, enormous structure-borne vibrations occur in the adjoining exhaust system. Those vibrations substantially result from the explosive and cyclical combustion operations of the fuel/air mix in the engine.

Very high acceleration forces occur in particular at the individual components of the exhaust system and may endanger the service life of a holder of a catalyst carrier body in an exhaust system.

SUMMARY OF THE INVENTION

It is accordingly an object of the invention to provide a catalyst assembly with a catalyst carrier body fixed in a housing, which overcomes the hereinafore-mentioned disadvantages of the heretofore-known devices of this general type and which is suitable in particular for ensuring a long residence time of the catalyst carrier body in a housing at a predeterminable location, with in particular transmission of structure-borne vibrations which occur in an exhaust system to the catalyst carrier body being damped.

With the foregoing and other objects in view there is provided, in accordance with the invention, a catalyst assembly, comprising a housing having at least first and second recesses with side surfaces, and a catalyst carrier body fixed in the housing. The catalyst carrier body has a casing tube and a honeycomb body through which an exhaust gas can flow. The casing tube has at least first and second protuberances with side surfaces and the casing tube is connected to the honeycomb body at least in a partial region. The protuberances extend at least partially into the recesses to form a fixed mounting and at least one floating mounting with an axial mounting play.

Catalyst carrier bodies of this type are used in particular to purify an exhaust gas and/or for catalytic conversion of pollutants which are contained in the exhaust gas from the internal combustion engine. The honeycomb body is connected to the casing tube, in particular by brazing, at least in the partial region. The fixed mounting ensures that the catalyst carrier body is permanently fixed in the housing. The floating mounting, due to its axial mounting play, permits expansions on the part of the catalyst carrier body which occur as a result of increases in the temperature of the catalyst carrier body.

In accordance with another feature of the invention, the at least first and/or second protuberances are constructed to run all the way around or circumferentially in the axial direction. The result of this is that a uniform mounting over the circumference of the casing tube is ensured.

In accordance with a further feature of the invention, the side surfaces of the protuberances and the lateral surface of the casing tube each include an outer angle. In this case, the outer angle of the fixed mounting is smaller than the outer angle of the floating mounting. It is preferable for the outer angle of the fixed mounting to be in the range from 90° to 110°. In this way, it is possible to absorb even high axial forces, such as occur in the exhaust-gas stream, for example, as a result of structure-borne vibrations and pulsation, through the use of the fixed mounting.

In accordance with an added feature of the invention, the housing has an inner surface, the side surfaces of the recesses and the inner surface of the housing each enclose an inner angle, and the inner angle of the fixed mounting is smaller than the inner angle of the floating mounting. In this way, the side surfaces of the protuberances are provided with corresponding side surfaces of the recesses, so that a form-locking connection between a protuberance and a recess is ensured over the largest possible area. Particularly in the case of the fixed mounting, this allows good structure-borne sound damping and in the case of the floating mounting, if appropriate, allows good radial guidance. A form-locking connection is one which connects elements together due to their shape, as opposed to a force-locking connection which uses external force.

In accordance with an additional feature of the invention, the inner angle is at most 5° greater than the outer angle of the fixed mounting. It is preferable for the inner angle to be equal to the outer angle of the fixed mounting. Making the inner angle and the outer angle the same size has the advantage that the side surfaces of the protuberances and the side surfaces of the recesses are disposed parallel to one another. This allows a particularly stable embodiment of a fixed and/or floating mounting to be produced.

In accordance with yet another feature of the invention, the recesses have a depth, the protuberances have a height, and the depth is at least 2 mm greater than the height. This also allows radial thermal expansion of the catalyst carrier body, with the occurrence of thermal stresses in the mounting being prevented.

In accordance with yet a further feature of the invention, the side surfaces of the protuberances bear against the side surfaces of the recesses, at least in the fixed mounting. In this case, in particular, a surface-to-surface mounting region is formed. The direct mounting has a particularly good damping action on structure-borne sound which occurs. The resulting acceleration forces are only then transmitted to a greatly reduced extent from the housing to the catalyst carrier body. This allows particularly long-term fixation of the catalyst carrier body in the exhaust system.

In accordance with yet an added feature of the invention, a filler material is disposed between the side surfaces of the protuberances and the side surfaces of the recesses, at least in the at least one floating mounting. The filler material is preferably a material which is temperature-resistant and is suitable for use in an exhaust system. A filler material of this type such as, for example, mica, allows thermal expansions on the part of the catalyst carrier body. The thermal expansion of the filler material is adapted in such a way that thermally produced gaps or cavities between the casing tube and the housing are closed up by the filler material. This ensures precise fixation in the mounting.

In accordance with yet an additional feature of the invention, the catalyst carrier body is substantially surrounded by the filler material. The result of this is that the entire catalyst carrier body is mounted with low levels of vibrations, since the filler material significantly reduces transmission of the acceleration forces from the housing to the catalyst carrier body.

In accordance with again another feature of the invention, an encircling cavity, in which preferably a heat-insulating medium, in particular air, is disposed, is formed between the protuberances of the casing tube and the honeycomb body. In this way, the protuberances have a further function in addition to that of mounting the catalyst carrier body. The cavity prevents a heat flux from the honeycomb body to the casing tube, with the result that the light-off performance of the honeycomb body is improved. This allows earlier catalytic conversion of pollutants in an exhaust gas flowing through the honeycomb body.

In accordance with again a further feature of the invention, the protuberance of the fixed mounting has a first axial length of from 1 to 20 mm, and the protuberance of the floating mounting preferably has a second axial length of from 10 to 30 mm. The first axial length may therefore, by way of example, be smaller, since the inner and/or outer angles of the fixed mounting are constructed to be smaller than those of the floating mounting. If the protuberance of the fixed mounting is constructed as a metal sheet disposed in the form of a collar, the first axial length can be limited to a very few millimeters. In principle, the floating mounting is only responsible for providing radial guidance and ensuring that thermal expansion can take place in the axial direction as well. The mounting play required to achieve this therefore also has to be taken into account when constructing the second axial length.

In accordance with again an added feature of the invention, exhaust gas flows through the honeycomb body in a preferred direction of flow and the fixed mounting is disposed downstream of the floating mounting. The hottest area of the honeycomb body is generally disposed close to the inlet side. Consequently, the thermal expansions are also greatest in this area. Placing the floating mounting in this area allows these thermal expansions to take place, thus preventing stresses which limit the service life.

In accordance with a concomitant feature of the invention, the housing has a two-part construction with half-shells. These half-shells are connected by a joining technique, in particular by welding, through the use of a longitudinal seam. The construction of a housing with two half-shells assists with placing filler material around the catalyst carrier body, for example during assembly, in order to allow the catalyst carrier body to be decoupled from the structure-borne vibrations of the housing.

Other features which are considered as characteristic for the invention are set forth in the appended claims.

Although the invention is illustrated and described herein as embodied in a catalyst assembly with a fixed catalyst carrier body, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
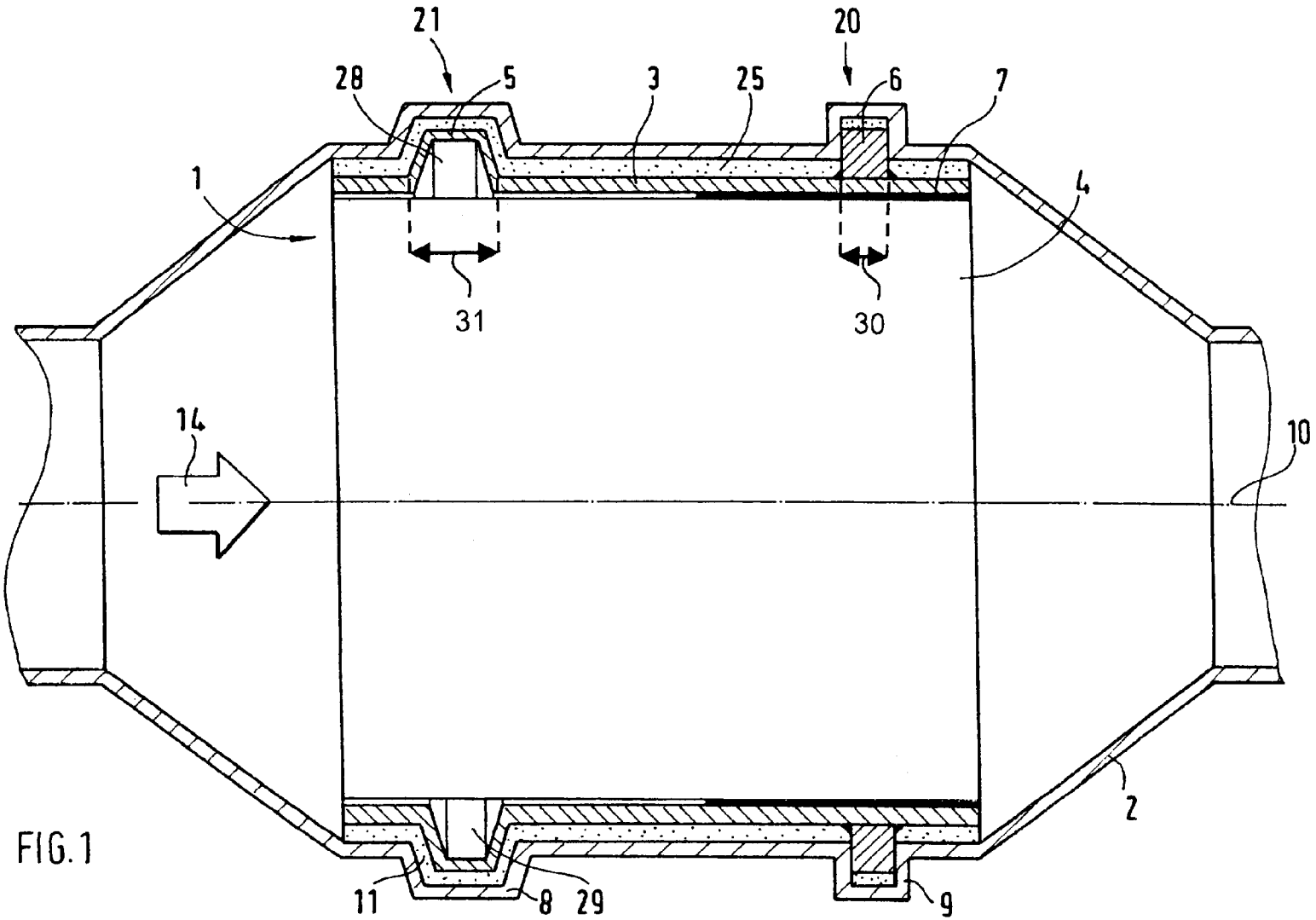
FIG. 1 is a fragmentary, diagrammatic, longitudinal-sectional view of a configuration according to the invention.

Referring now to the figures of the drawings in detail and first, particularly, to FIG. 1 thereof, there is seen a diagrammatic, sectional illustration of a configuration according to the invention for fixation of a catalyst carrier body 1 in a housing 2. The catalyst carrier body 1 includes a honeycomb body 4 through which an exhaust gas can flow in a preferred direction of flow 14 and which is surrounded by a casing tube 3. The casing tube 3 is connected to the honeycomb body 4, preferably by brazing, in a partial region 7. The casing tube 3 has a first protuberance 5 and a second protuberance 6. Accordingly, the housing 2 has first and second recessed portions for this purpose, which will be referred to below as first and second recesses 8, 9. The protuberances 5 and 6 extend into the recesses 8 and 9 in such a way as to form a fixed mounting 20 and a floating mounting 21 with a mounting play 11 in the axial direction 10. The first protuberance 5 and the second protuberance 6 are constructed to run all the way around or circumferentially in an axial direction 10. The floating mounting 21 is disposed upstream of the fixed mounting 20, in the direction of flow 14. The catalyst carrier body 1 is additionally surrounded by a filler material 25. Fixation of the catalyst carrier body 1 in the housing 2 in this manner has the advantage of preventing transmission of structure-borne vibrations from the housing 2 to the catalyst carrier body 1.

The first protuberance 5 of the casing tube 3 has a cavity 28 which runs all the way around the honeycomb body 4 and in which a heat-insulating medium is disposed. This cavity 28 suppresses heat transfer from the honeycomb body 4 to the casing tube 3, with the result that faster heating of the honeycomb body 4 and therefore also earlier catalytic conversion of pollutants in the exhaust gas are ensured. In this case, the second protuberance 6 is constructed as a type of collar which has been welded onto the casing tube 3. This firstly ensures that the casing tube 3 is continuously connected to the honeycomb body 4 in the partial region 7 and also enables a first axial length 30 of the fixed mounting 20 to be relatively short, as compared to a second axial length 31 of the floating mounting 21.

Figure 2:
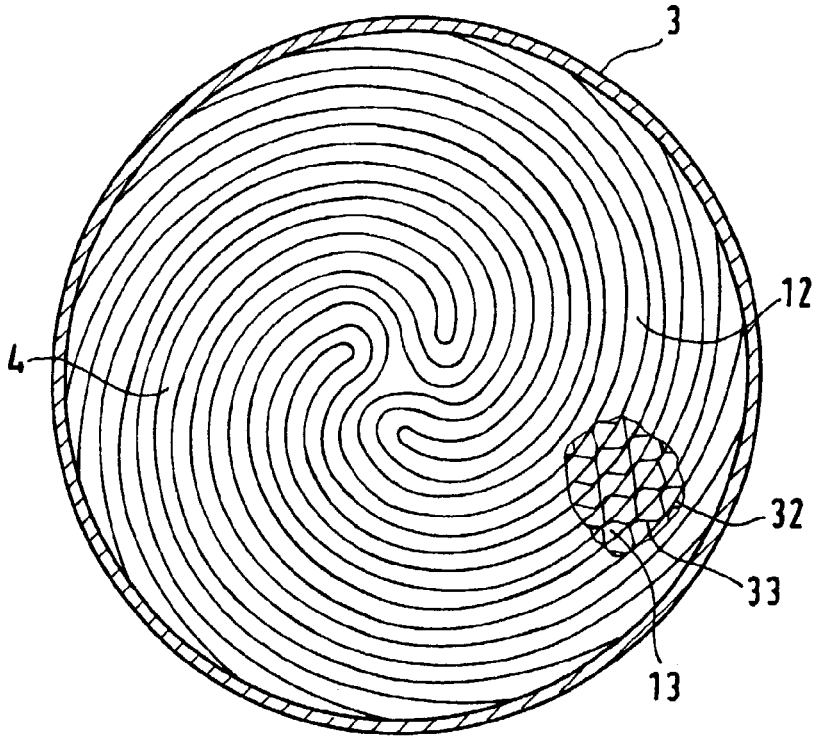
FIG. 2 is a partly sectional, end-elevational view of a configuration of a honeycomb body with a casing tube.

FIG. 2 shows an end-elevational view of an embodiment of a honeycomb body 4 with a casing tube 3. The honeycomb body 4 has sheet-metal layers 12 which are structured in such a way that an exhaust gas can flow through them. The sheet-metal layers 12 include smooth metal sheets 32 and corrugated metal sheets 33, so that passages or channels 13 through which an exhaust gas can flow are formed. The sheet-metal layers 12 are layered or stacked and then looped or coiled, with the result that the honeycomb body 4 is formed.

Figure 3:
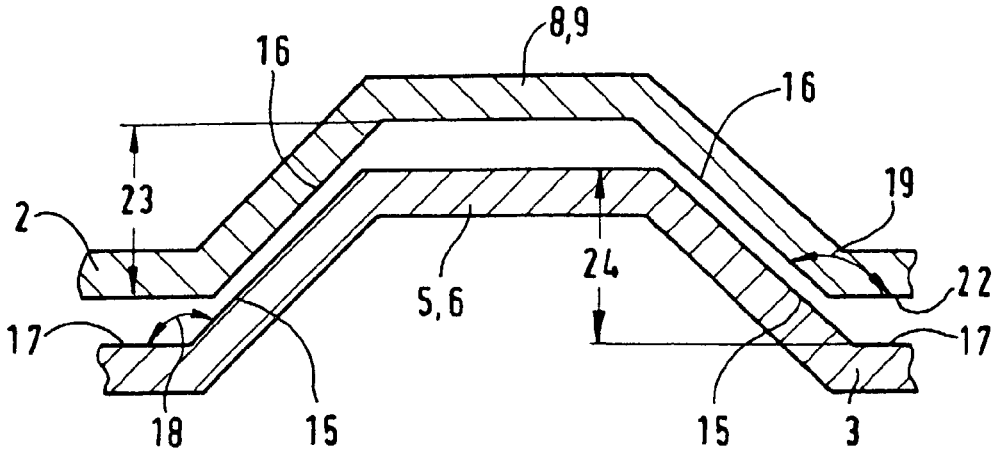
FIG. 3 is a fragmentary, sectional view of a protuberance of the casing tube with a corresponding recess in a housing.

FIG. 3 diagrammatically depicts a fragmentary view of a protuberance 5, 6 of the casing tube 3 with a corresponding recess 8, 9 in the housing 2. The casing tube 3 has a lateral surface 17, which encloses an outer angle 18 together with side or flank surfaces 15 of the protuberance 5, 6. In addition, the protuberance 5, 6 has a height 24 starting from the lateral surface 17. The protuberance 5, 6 extends at least partially into a corresponding recess 8, 9.

The recesses 8 and 9 have two side surfaces 16, which are preferably formed all the way around and which enclose an inner angle 19 with an inner surface 22 of the housing 2. It is not necessary for the recesses 8 and 9 and protuberances 5 and 6 to be symmetrical in structure, but this does reduce manufacturing costs. A depth 23 of the recess 8, 9 is preferably at least 2 mm greater than the height 24 of the protuberance 5, 6.

Figure 4:
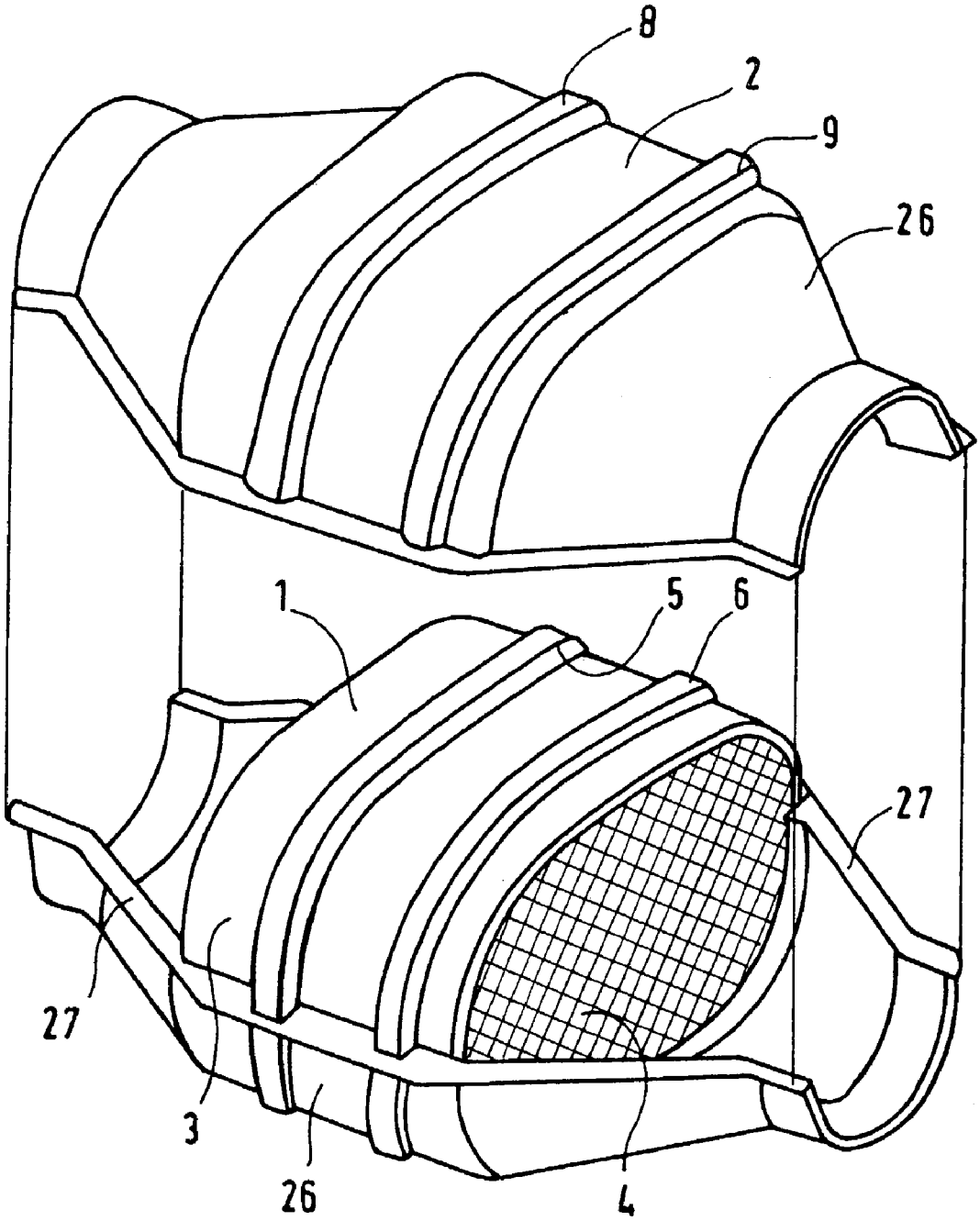
FIG. 4 is a perspective view of a configuration of a catalyst carrier body in a two-part housing.

FIG. 4 shows a perspective and diagrammatic illustration of a further embodiment of a configuration according to the invention for the fixation of a catalyst carrier body 1 in a housing 2. The housing 2 is constructed with two half-shells 26 which, after the catalyst carrier body 1 has been disposed in the interior of the housing 2, are connected to one another at two longitudinal seams 27. It is preferable for the half-shells 26 to be welded at the longitudinal seams 27. The housing 2 including the half-shells 26 in this case likewise has recesses 8 and 9 which match the protuberances 5 and 6 of the casing tube 3 of the catalyst carrier body 1. This configuration of the housing 2 with two half-shells 26 is suitable in particular for filler material 25 which is not illustrated in FIG. 4 but which surrounds the catalyst carrier body 1 and prevents structure-borne vibrations from being transmitted from the housing 2 to the casing tube 3, to be disposed therein. The filler material 25 is disposed in such a way that the end side of the honeycomb body 4 is not reduced in size.

The configuration according to the invention, in particular in the event of structure-borne vibrations occurring in the exhaust system of an internal combustion engine, ensures permanent fixation of the catalyst carrier body. That can be utilized advantageously in particular for honeycomb bodies made from very thin metal foils with a thickness of less than 30 μ.

We claim:

1. A catalyst assembly, comprising:

a housing having at least first and second recesses with side surfaces; and a catalyst carrier body fixed in said housing, said catalyst carrier body having a casing tube and a honeycomb body through which an exhaust gas can flow, said casing tube having at least first and second protuberances with side surfaces and said casing tube being connected to said honeycomb body at least in a partial region, said protuberances extending at least partially into said recesses to form a fixed mounting and at least one floating mounting with an axial mounting play.

2. The assembly according to claim 1, wherein at least one of said first and second protuberances extend all the way around in axial direction.

3. The assembly according to claim 1, wherein said casing tube has a lateral surface, said side surfaces of said protuberances and said lateral surface of said casing tube each enclose an outer angle together, and said outer angle of said fixed mounting is smaller than said outer angle of said at least one floating mounting.

4. The assembly according to claim 1, wherein said housing has an inner surface, said side surfaces and said inner surface of said housing each enclose an inner angle together, and said inner angle of said fixed mounting is smaller than said inner angle of said at least one floating mounting.

5. The assembly according to claim 1, wherein said casing tube has outer angles, said housing has inner angles, and said inner angle of said fixed mounting is at most 5° larger than said outer angle of said fixed mounting.

6. The assembly according to claim 1, wherein said casing tube has outer angles, said housing has inner angles, and said inner angle of said fixed mounting is equal to said outer angle of said fixed mounting.

7. The assembly according to claim 1, wherein said recesses have a depth, said protuberances have a height, and said depth is at least 2 mm greater than said height.

8. The assembly according to claim 1, wherein said casing tube has side surfaces, said housing has side surfaces, and said side surfaces of said protuberances bear against said side surfaces of said recesses, at least in said fixed mounting.

9. The assembly according to claim 1, wherein said casing tube has side surfaces, said housing has side surfaces, and a filler material is disposed between said side surfaces of said protuberances and said side surfaces of said recesses, at least in said at least one floating mounting.

10. The assembly according to claim 9, wherein said filler material is mica.

11. The assembly according to claim 9, wherein said catalyst carrier body is substantially surrounded by said filler material.

12. The assembly according to claim 1, wherein said protuberances of said casing tube and said honeycomb body define an encircling cavity therebetween.

13. The assembly according to claim 12, which further comprises a heat-insulating medium in said encircling cavity.

14. The assembly according to claim 13, wherein said heat-insulating medium is air.

15. The assembly according to claim 1, wherein said protuberance of said fixed mounting has a first axial length of from 1 to 20 mm, and said protuberance of said at least one floating mounting has a second axial length of from 10 to 30 mm.

16. The assembly according to claim 1, wherein said honeycomb body conducts the exhaust gas in a preferred direction of flow, and said fixed mounting is disposed downstream of said at least one floating mounting in said preferred direction of flow.

17. The assembly according to claim 1, wherein said housing has a two-part construction with a longitudinal seam and two half-shells being connected to one another by a joining technique at said longitudinal seam.

18. The assembly according to claim 17, wherein said joining technique is welding.

* * * * *